US006202560B1

(12) United States Patent
Guirguis

(10) Patent No.: US 6,202,560 B1
(45) Date of Patent: Mar. 20, 2001

(54) EXPLOSIVELY STARTED PROJECTILE GUN AMMUNITION

(75) Inventor: Raafat Guirguis, Fairfax, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/225,677

(22) Filed: Jan. 6, 1999

(51) Int. Cl.[7] ..... F42B 5/02
(52) U.S. Cl. ..... 102/430; 102/443; 102/470
(58) Field of Search ..... 102/202, 430, 102/431, 433, 434, 440, 441, 443, 469, 470

(56) References Cited

U.S. PATENT DOCUMENTS

| | | | | |
|---|---|---|---|---|
| 314,127 | * | 3/1885 | Hope et al. | 102/443 |
| 390,232 | * | 10/1888 | Hurst | 102/443 |
| 562,535 | * | 6/1896 | Hurst | 102/443 |
| 948,148 | * | 2/1910 | Schenk . | |
| 1,556,160 | * | 10/1925 | Riggs . | |
| 4,245,557 | * | 1/1981 | Knappworst et al. . | |
| 4,770,099 | * | 9/1988 | Brede et al. . | |
| 4,799,428 | * | 1/1989 | Yunan . | |
| 4,803,926 | * | 2/1989 | Barton et al. | 102/430 |
| 5,052,302 | * | 10/1991 | Taddeo et al. | 102/470 |
| 5,123,356 | * | 6/1992 | Brooks et al. . | |
| 5,173,571 | * | 12/1992 | Montgomery | 102/443 |
| 5,465,665 | * | 11/1995 | Diehl | 102/470 |
| 5,557,059 | * | 9/1996 | Warren et al. | 102/443 |

FOREIGN PATENT DOCUMENTS

| | | | | |
|---|---|---|---|---|
| 4841 | * | 4/1892 | (CH) | 102/433 |
| 2517046 | * | 5/1983 | (FR) | 102/470 |

* cited by examiner

*Primary Examiner*—Harold J. Tudor
(74) *Attorney, Agent, or Firm*—Mark Homer

(57) ABSTRACT

A separate explosive charge within a cartridge is detonated to initiate motion of a projectile and effect delayed ignition of a larger volume of primary propellant. Steady burning of the ignited primary propellant after motion of the projectile is initiated, continues its propulsion with a pressure/displacement profile.

7 Claims, 1 Drawing Sheet

EXPLOSIVELY STARTED PROJECTILE GUN AMMUNITION

The present invention relates in general to the propulsion of a projectile from the cartridge of an ammunition round in response to buildup of pressure within a gun chamber.

BACKGROUND OF THE INVENTION

Ammunition rounds from which projectiles are propelled by pressurized gases, are well known in the art, together with associated igniters, explosives, propellant charges and other common means as disclosed for example in U.S. Pat. Nos. 4,770,099, 4,799,428 and 5,123,356 to Brede et al., Yunan and Brooks et al., respectively. Usually in such prior art ammunition rounds the burning propellant is the sole gas generating source for build up of pressure within the gun chamber until motion resisting friction and inertia are overcome and the projectile starts moving. As the projectile moves forward, the accompanying increase in chamber volume relieves some of the rapid buildup of pressure due to gas generation. The peak value of the pressure is determined by competition between rate of gas generation and rate of volumetric expansion. Because the rate of gas generation depends on the amount of propellant, the strength of the gun limits the acceptable amount of propellant that can be safely burnt, which in turn limits the muzzle velocity of the projectile.

It is therefore an important object of the present invention to provide an ammunition round in which projectile movement begins in response to an independent source of gas pressure so as to safely accommodate a larger quantity of propellant usually resulting in increased muzzle velocity of the projectile.

SUMMARY OF THE INVENTION

Pursuant to the present invention, a relatively small explosive charge is detonated within the cartridge of an otherwise conventional ammunition round for rapid release of energy within a short time window preceding steady burning of the larger body of a primary propellant charge. Within such time window, the detonating explosive charge generates sufficient gas pressure to both initiate early movement of the projectile and ignite the primary propellant. The gases surrounding the explosive are compressed to form a hot plasma, which helps ignite propellants that do not easily start burning. Nevertheless, even after ignition within the short detonation time window, the primary propellant undergoes only partial burn. Eventually the major portion of the propellant undergoes steady burn, but during such steady burning of the propellant the gas pressure increases less rapidly than that in conventional ammunition because of the gas expansion accompanying early projectile movement.

In accordance with certain embodiments of the invention, the explosive charge assumes the configuration of a cord held centered along the axis of a larger diameter ullage tube. The explosive charge is thereby separated from the body of the primary propellant by a chamber of gas within a plastic capsule all enclosed within the cartridge casing. Plasma is formed from such gas when the explosive cord is detonated. The gas pressure generated by detonation of the explosive cord is exerted on the projectile to induce initial movement thereof from one axial end of the ullage tube abutting the projectile, opposite the other axial end of the tube at which the cord is ignited. Spaced injection ports along the ullage tube allow hot gases from the detonating cord to pass through and ignite the main propellant charge.

BRIEF DESCRIPTION OF DRAWING FIGURES

A more complete appreciation of the invention and many of its attendant advantages will be readily appreciated as the same becomes better understood by reference to the following detailed description when considered in connection with the accompanying drawing wherein.

BRIEF DESCRIPTION OF PREFERRED EMBODIMENT

Figure 1:
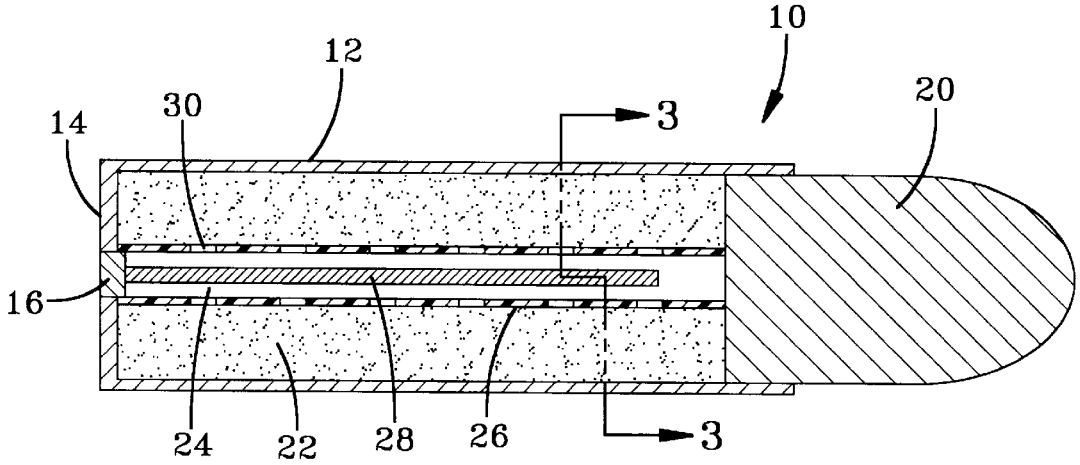
FIG. 1 is a side section view of an ammunition round, constructed in accordance with one embodiment of the invention.
Figure 3:
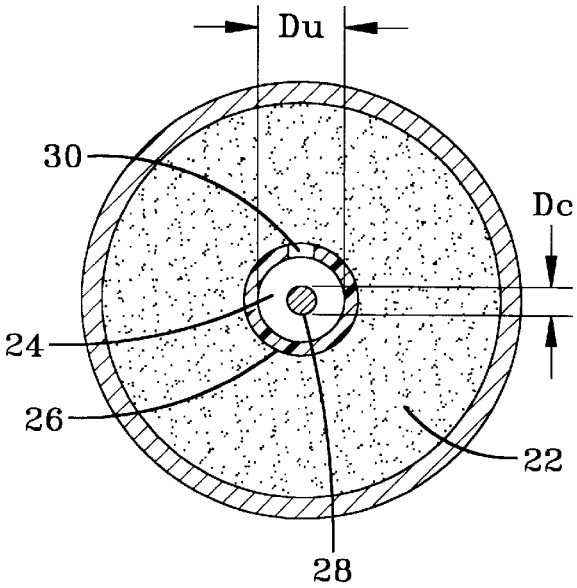
FIG. 3 is a section view taken substantially through a plane indicated by section line 3—3 in FIG. 1.

Referring now to the drawing in detail, FIGS. 1 and 3 illustrate an ammunition round generally referred to by reference numeral 10, having a cylindrical cartridge casing 12 closed at one axial end by a wall 14 and centrally mounting therein a detonator 16. The other open axial end of the cartridge casing 12 accepts and holds a projectile 20. A body of primary propellant 22 is enclosed within the cartridge casing 12 between the end wall 14 and the projectile as shown in FIG. 1.

In accordance with the present invention, an explosive cord 28 is centrally positioned along the axis of a plastic ullage tube 26 coaxially positioned within the cartridge casing 12. Such cord 28 is surrounded by gas enclosed within a chamber 24 formed within tube 26 between the detonator 16 and the projectile 20. The detonator 16 abuts the explosive cord 28 which extends into the ullage tube 26 but terminates therein in axially spaced relation to the projectile 20. The volume of gas within chamber 24 enclosed by the ullage tube 26 in surrounding relation to the explosive cord 28 in the illustrated embodiment, is determined by the axial length of the ullage tube 26 having a diameter (Du) that is about three times the diameter (Dc) of the explosive cord 28. Such volume of gas allows expansion of explosive detonation products 8 to 9 times, causing a 60 to 80 fold reduction in pressure to a manageable level of 5 kbar. If no precautions are taken during manufacture, air is naturally entrapped in chamber 24. Better gases such as argon or xenon, which produce higher temperatures when compressed, may be introduced into a completely sealed tube 26 according to other embodiments. Because detonation waves propagate at a high velocity (usually 8 km/s), the volume of the gas in the ullage chamber 24 is pressurized to 5 kbar within a 100 microsecond time window (for an explosive cord 28 of 80 cm in length or less). Such time window is much shorter than the usual time window of 500 $\mu$s before the primary propellant charge 22 begins steady burn. At that the end of the 100 $\mu$s time window, the detonation products of the explosive charge 28 reach the base of the projectile 20 so as to initiate its movement.

With continued reference to FIGS. 1 and 3, the ullage tube 26 is provided with a plurality of axially spaced injection ports 30 through which the hot gases produced by detonation of the explosive cord 28 as well as other gases within chamber 24 are distributed to the body of propellant 22 for ignition thereof. The size of the injection ports 30 is adjusted and a propellant 22 having a rapid ignition rate is selected in order to achieve a resultant gas pressure (P) that varies with the projectile displacement (X) as graphically diagrammed by curve 32 in FIG. 2.

Figure 2:
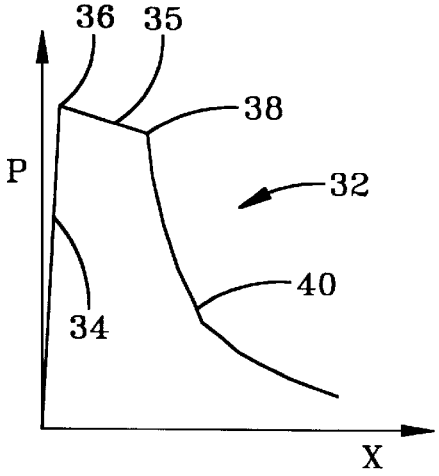
FIG. 2 is a graph depicting propulsion characteristics of the ammunition round shown in FIG. 1.

Detonation of the explosive cord 28 as aforementioned, initially produces a rapid increase in the gas pressure (P) up to 5 kbar as indicated by the sharply rising portion 34 of curve 32 in FIG. 2. Such rise in propellant gas pressure reaches a peak value of 5 kbar, as indicated by point 36 in FIG. 2.

Once the explosive cord 28 is consumed and the projectile 20 starts moving, the accompanying volumetric expansion will tend to cause a rapid drop in gas pressure from the peak value 36. However, since the propellant starts burning at that point, pressure decreases from peak 36 rather slowly at a substantially constant rate along portion 35 of curve 32 in view of factors introduced by the aforementioned selections of injection port size and propellant burn rate. When the velocity of the moving projectile is high enough so that the gas generated by the burning propellant cannot compensate for the volumeric expansion, the gas pressure decreases rather rapidly as reflected by curve portion 40 of curve 32, in view of the continued gas expansion accompanying accelerated movement of the projectile 20 from the cartridge casing 12 into a gun barrel.

It is apparent from the foregoing description that the detonating explosive cord 28 is an independent source of generated gas pressures which initiates early movement of projectile 20 and also ignites the body of primary propellant 22. Burning of the ignited body of propellant 22 continues acceleration of the projectile 20 through the bore of the gun barrel to its muzzle end. Because the projectile 20 is already moving when the ignited primary propellant 22 begins steady burn, more propellant may be utilized pursuant to the present invention so as to obtain higher muzzle velocities for the projectile without exceeding the peak pressure limit.

Obviously, other modifications and variations of the present invention may be possible in light of the foregoing teachings. It is therefore to be understood that within the scope of the appended claims the invention may be practiced otherwise than as specifically described.

What is claimed is:

1. An ammunition round, comprising:

a cartridge casing having a closed rear end and an open front end;

a projectile located within said open front end of said cartridge casing;

a detonator located in said closed rear end of said cartridge casing;

a tube extending axially from the detonator to a base of the projectile;

a detonating explosive extending axially from the detonator within said tube;

a gas filled space, surrounding said detonating explosive, between said detonating explosive and said tube;

a body of propellant located between said tube and said cartridge casing whereby upon detonation of said detonating explosive, by said detonator, gas pressure is generated which initiates movement of said projectile independently of said body of propellant and provides for a delayed ignition of the body of propellant to continue said movement of the projectile.

2. The ammunition round as defined in claim 1, wherein said tube includes spaced ports therein through which said gas pressure is distributed into said body of propellant.

3. The ammunition round as defined in claim 1, wherein said detonating explosive terminates in axially spaced relation to the projectile.

4. The ammunition round as defined in claim 1, wherein the detonation of the detonating explosive compresses the gas within the gas filled space to form hot plasma enhancing said delayed ignition of the body of propellant.

5. The ammunition round as defined in claim 1, wherein said gas is selected from the group consisting of argon and xenon.

6. The ammunition round as defined in claim 1, wherein the tube has a diameter about three times greater than the diameter of said detonating explosive.

7. The ammunition round as defined in claim 1, wherein said detonating explosive is a single detonating explosive cord.

* * * * *